US007100550B2

(12) United States Patent
Sheldon et al.

(10) Patent No.: US 7,100,550 B2
(45) Date of Patent: Sep. 5, 2006

(54) TWO-STROKE ENGINE TRANSFER PORTS

(75) Inventors: John D. Sheldon, Anderson, SC (US); Nagesh S. Navinahally, Anderson, SC (US)

(73) Assignee: Homelite Technologies, Ltd., Hamilton (BM)

( * ) Notice: Subject to any disclaimer, the term of this patent is extended or adjusted under 35 U.S.C. 154(b) by 0 days.

(21) Appl. No.: 10/479,260

(22) PCT Filed: Oct. 6, 2003

(86) PCT No.: PCT/US03/31470

§ 371 (c)(1),
(2), (4) Date: Dec. 1, 2003

(87) PCT Pub. No.: WO2004/033869

PCT Pub. Date: Apr. 22, 2004

(65) Prior Publication Data

US 2004/0244739 A1 Dec. 9, 2004

(51) Int. Cl.
*F02B 75/02* (2006.01)

(52) U.S. Cl. ..... 123/65 P; 123/65 PE

(58) Field of Classification Search ..... 123/73 R, 123/65 P, 73 PP, 65 PE

See application file for complete search history.

(56) References Cited

U.S. PATENT DOCUMENTS

| | | | | |
|---|---|---|---|---|
| 2,115,657 A | | 4/1938 | Venediger | |
| 2,440,645 A | | 4/1948 | Pyk et al. | |
| 3,131,680 A | * | 5/1964 | King | 123/74 D |
| 3,382,857 A | | 5/1968 | Foster et al. | |
| 3,752,129 A | | 8/1973 | Kobayashi et al. | |
| 4,016,850 A | | 4/1977 | Bloemers | |
| 4,161,163 A | | 7/1979 | Boyesen | |
| 4,202,298 A | | 5/1980 | Boyesen | |
| 4,233,717 A | | 11/1980 | Noda et al. | |
| 4,287,860 A | | 9/1981 | Fujikawa et al. | |
| 4,329,948 A | | 5/1982 | Fujikawa et al. | |
| 4,337,734 A | | 7/1982 | Iio | |
| 4,395,978 A | | 8/1983 | Boyesen | |
| 4,458,636 A | | 7/1984 | Kania | |
| 4,643,140 A | | 2/1987 | Whipple | |
| 4,651,686 A | | 3/1987 | Kania | |
| 4,821,687 A | | 4/1989 | Iwai | |
| 4,899,698 A | | 2/1990 | Thery | |
| 5,086,734 A | | 2/1992 | Nakai | |
| 5,251,580 A | | 10/1993 | Torigai | |
| 5,361,731 A | | 11/1994 | Tanaka | |
| 5,372,105 A | | 12/1994 | Nagao et al. | |
| 5,471,960 A | | 12/1995 | Nagao et al. | |
| 5,490,483 A | | 2/1996 | Tanikake et al. | |
| 5,699,761 A | | 12/1997 | Yamaguchi et al. | |
| 5,826,567 A | | 10/1998 | Sakaguchi et al. | |
| 5,870,981 A | * | 2/1999 | Knaus et al. | 123/65 A |
| 5,881,687 A | | 3/1999 | Sakaguchi et al. | |
| 5,947,066 A | | 9/1999 | Ishikawa | |
| 5,992,358 A | | 11/1999 | Otome | |

(Continued)

*Primary Examiner*—Mahmoud Gimie
(74) *Attorney, Agent, or Firm*—Brinks Hofer Gilson & Lione

(57) ABSTRACT

A two-stroke internal combustion engine including a cylinder; and a piston movably mounted in the cylinder. The cylinder includes an exhaust port and transfer ports. The transfer ports include a first pair of the transfer ports disposed closer to the exhaust port than a second pair of the transfer ports which are disposed further away from the exhaust port. The first pair of transfer ports are angled relative to each other at a first angle of about 70° to about 85° and the second pair of transfer ports are angled relative to each other at a second angle of about 120° to about 150°. Directional discharge of scavenged air out of the transfer ports 10 establishes a flow path for the scavenged air to minimize losses of the fresh unburned fuel into the exhaust port.

37 Claims, 8 Drawing Sheets

U.S. PATENT DOCUMENTS 6,016,776 A 1/2000 Jonsson
6,223,705 B1 * 5/2001 Sato et al. ..... 123/73 PP
6,286,469 B1 9/2001 Cobb, Jr.
6,293,235 B1 9/2001 Cobb, Jr.
6,298,811 B1 10/2001 Sawada et al.
6,367,432 B1 4/2002 Araki
6,382,176 B1 5/2002 Cobb, Jr.
6,598,568 B1 7/2003 Rosskamp et al.

* cited by examiner

TWO-STROKE ENGINE TRANSFER PORTS

CROSS-REFERENCE TO RELATED APPLICATIONS

This application claims priority to U.S. application Ser. No. 10/264,939, filed Oct. 4, 2002 and application Ser. No. 10/452,079, filed May 30, 2003.

BACKGROUND OF THE INVENTION

1. Field of the Invention

The present invention relates to internal combustion engines and, more particularly to a transfer system.

2. Background Art

U.S. Pat. No. 6,367,432 discloses a two-stroke cycle internal combustion engine which has a quaternary Schnurle-type scavenging system that is configured such that the capacity of a pair of second scavenging passageways are made larger than te capacity of a pair of first scavenging passageways, so that during the descending stroke of the piston, air is allowed to be introduced into the combustion actuation chamber from the second scavenging passageways prior to the introduction of the air-fuel mixture and at the same time, a relatively large quantity of air is allowed to be introduced into the combustion actuating chamber from the first scavenging passageways over a longer period of time as compared with the period of time in which air is introduced from the second scavenging passageways.

U.S. Pat. No. 6,223,705 discloses a two-stroke internal combustion engine having a Schnurle scavenging system includes a pair of first scavenging ports and a pair of second scavenging ports. An inner horizontal scavenging angle formed close to an exhaust port and an outer horizontal scavenging angle formed remote from the exhaust port by a pair of scavenging flows blown out of the pair of the first scavenging ports are both set to an angle in the range of from 116 to 124 degrees. An inner horizontal scavenging angle formed close to the exhaust port and an outer horizontal scavenging angle formed remote from the exhaust port by a pair of scavenging flows blown out of the pair of the second scavenging ports are set to angles in the ranges of rom 126 to 135 degrees and from 146 to 154 degrees, respectively.

Because of increasing government pollution emissions standards, there is a continuing need to lower engine emissions in two-stroke engines. One of the sources of emission problems has been the discharge of unburned hydrocarbons due to short circuiting of fuel out of an exhaust port during an upward stroke of the piston before the exhaust port is closed. Thus, there is a need to minimize the loss of fresh, short circuit fuel exiting out of the exhaust. This minimization can result in lower hydrocarbon emissions and higher fuel economy.

SUMMARY OF THE INVENTION

In accordance with one of the present invention, a two-stroke internal combustion engine is provided including a cylinder; and a piston movably mounted in the cylinder. The cylinder includes an exhaust port and transfer ports. The transfer ports include a first pari of the transfer ports disposed closer to the exhaust port than a second pair of the transfer ports which are disposed further away from the exhaust port. The first pair of transfer ports are angled relative to each other at a first angle of about 70° to about 85° and the second pair of transfer ports are angled relative to each other at a second angle of about 120° to about 150°. Directional discharge of scavenged air out of the transfer ports establishes a flow path for the scavenged air to minimize losses of fresh unburned fuel into the exhaust port.

In accordance with another aspect of the present invention, a two-stroke internal combustion engine is provided comprising a cylinder; and a piston movably mounted in the cylinder. The cylinder comprises an exhaust port and transfer ports. Two of the transfer ports comprise a common bottom channel extending into a side wall of the cylinder in a bottom portion of the cylinder and separate respective top channels. The cylinder comprises a partition wall extending between the two ports to form the two separate top channels.

In accordance with one method of the present invention, a method of introducing scavenged air into a cylinder of a two-stroke internal combustion engine is provided comprising steps of providing the cylinder with an exhaust port and two pairs of transfer ports being located in closer proximity to the exhaust port than a second one of the pairs of transfer ports; opening the second pair of transfer ports to a combustion chamber of the engine by a piston of the engine as the piston moves towards a bottom dead center position before the piston opens the first pair of transfer ports; and opening the first pair of transfer ports by the piston. The second pair of transfer ports is located further away from the exhaust port is opened into the combustion chamber before the first pair of transfer ports is opened into the combustion chamber.

In accordance with other aspects of the present invention, a two-stroke internal combustion engine is provided having a cylinder and a piston movably mounted therein. The cylinder defines an exhaust port and at least one pair of opposed transfer ports directed inwardly toward a transverse center line generally away from the exhaust port toward an opposed cylinder wall wherein the charge from the at least one pair of transfer ports meets in a compact convergence zone spaced between the cylinder central axis and the front wall. Preferably, the convergence zone is spaced from the cylinder axis more than 0.4 times the cylinder radius and most preferably, 0.5–0.8 times the cylinder radius.

In accordance with other aspects of the present invention, a two-stroke internal combustion engine is provided comprising a cylinder and a piston movably mounted therein. This cylinder includes an exhaust port and at least one pair of transfer ports spaced on opposite sides thereof and directing intake charge inwardly and generally away from the exhaust port, the exhaust port opening is 116°–121° after TDC and most preferably, 117°–120° after TDC.

In accordance with other aspects of the present invention, a two-stroke internal combustion engine is provided comprising a cylinder and a piston movably mounted therein. This cylinder includes an exhaust port and at least one pair of transfer ports spaced on opposite sides thereof and directing intake charge inwardly and generally away from the exhaust port wherein the transfer ports open 8°–15° after the exhaust port opens and preferably, 10°–12° after the exhaust port opens.

In accordance with other aspects of the present invention, a two-stroke internal combustion engine is provided comprising a cylinder and a piston movably mounted therein. This cylinder includes an exhaust port and at least one pair of transfer ports spaced on opposite sides thereof and directing intake charge inwardly and generally away from the exhaust port wherein the exhaust port has a restricted blow down region which opens initially, providing 20%–30% of the total exhaust port area, the blow down region having a circumferential length which is substantially less than the maximum exhaust port circumferential length and preferably, approximately about 50% of the maximum exhaust port length.

DETAILED DESCRIPTION OF THE PREFERRED EMBODIMENT(S)

Figure 1:
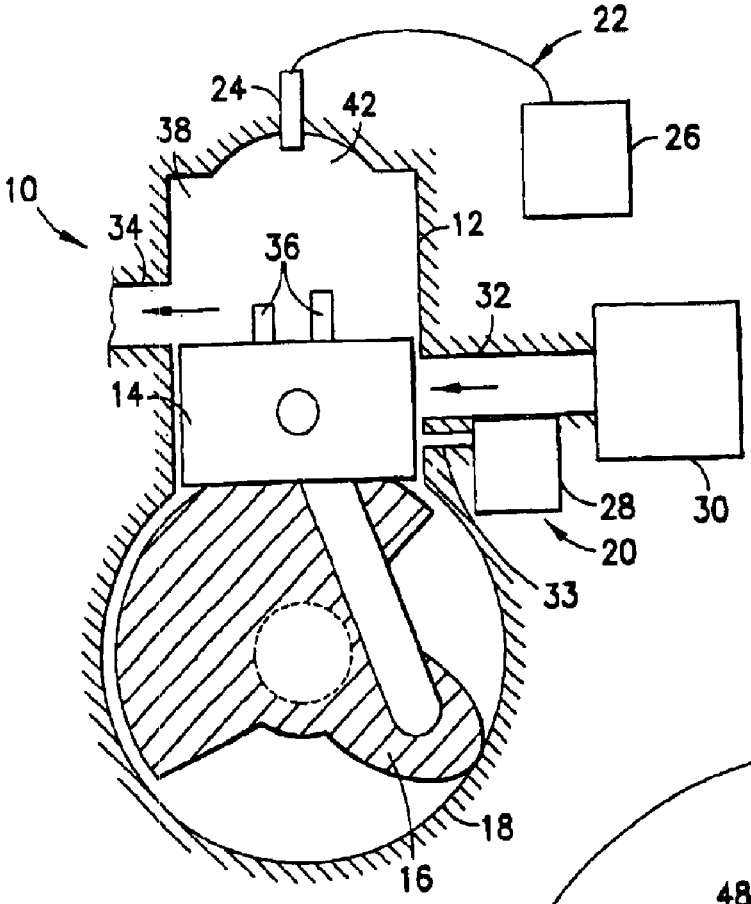
FIG. 1 is a diagrammatic view of an internal combustion engine incorporating features of the present invention.

Referring to FIG. 1, there is shown a partial diagrammatic view of an internal combustion engine 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

The engine 10 is a two-stroke engine having a cylinder 12, a piston 15, a crankshaft 16, a crankcase 18, a fuel delivery system 20, and an ignition system 22. One type of specific application for the engine 10 could be in a small high speed two-stroke engine such as utilized in a hand-held power tool, such as a leaf blower, string trimmer, head trimmer, chain saw, etc.

The ignition system 22 generally comprises a spark plug 24 and an electrical generating system 26 connected to the spark plug 24. However, in alternate embodiments, any suitable type of ignition system could be used. The ignition system 22 is generally well known in the art.

The fuel delivery system 20 generally comprises a carburetor 28, an air filter 30, a main air inlet 32 into the cylinder 12, and a fuel and air inlet 33 into the bottom of the cylinder 12. However, in alternate embodiments, any suitable type of fuel delivery system could be used. For example, the fuel delivery system 20 could comprise a conventional fuel delivery system well known in the art. Alternatively, the fuel delivery system could comprise a fuel injection system or a newer type of efficient, fuel delivery system such as disclose din U.S. Pat. Nos. 6,295,957; 6,293,235; 6,286,469; and 6,382,176 which are hereby incorporated by reference in their entireties.

Figure 2:
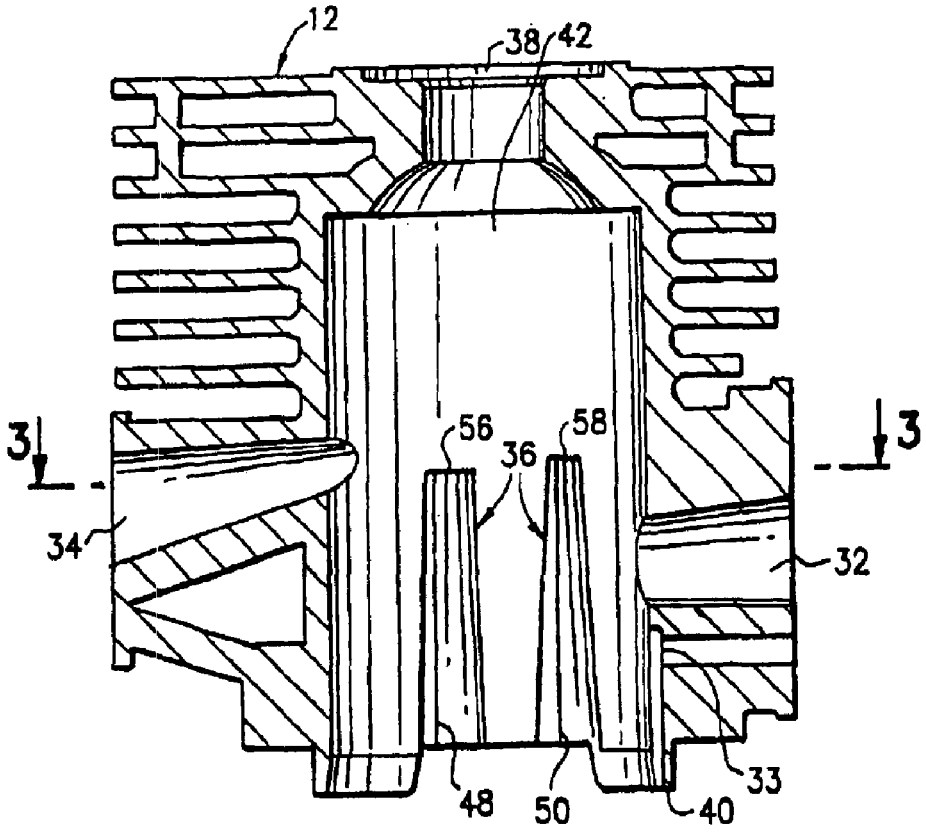
FIG. 2 is a cross sectional view of the cylinder of the engine shown in FIG. 1.

The piston 14 is movably mounted in the cylinder 12 and is operably connected to the crankshaft 16 in a conventional manner. Referring also to FIG. 2, the bottom 40 of the cylinder 12 is connected to the crankcase 18. In addition to the inlet 32, the cylinder 12 also comprises an exhaust outlet 34 and transfer ports 36. A muffler (not shown) could be attached to the exhaust outlet 34. The cylinder 12 comprises a main internal area 38 which the piston 14 reciprocally moves in, and which forms a combustion chamber 42.

Figure 3:
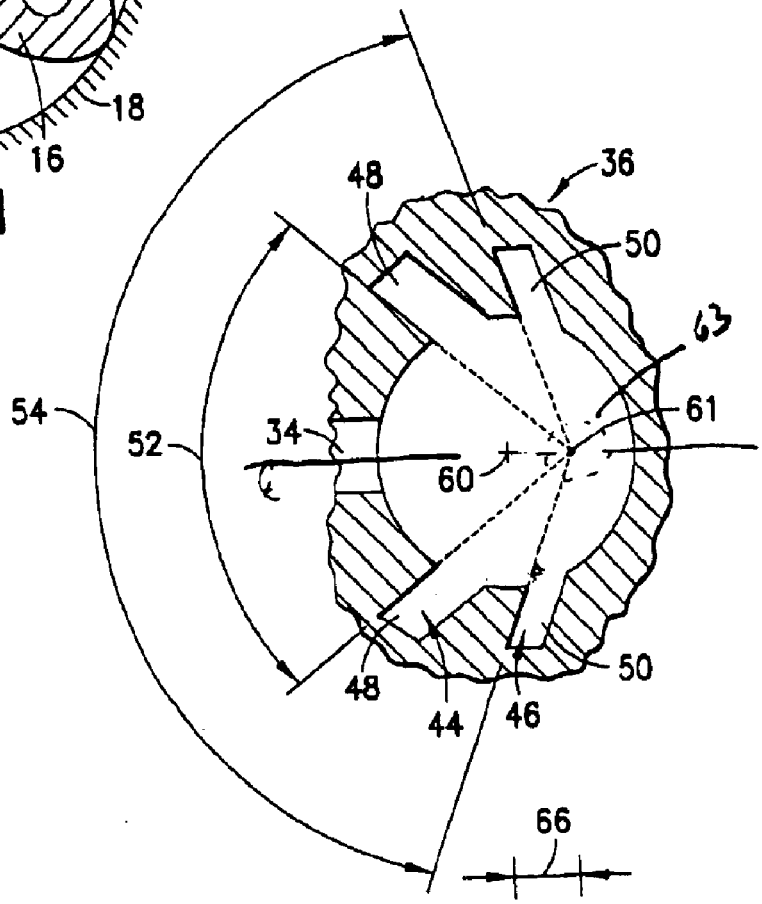
FIG. 3 is a cross sectional view of the cylinder shown in FIG. 2 taken along line 3—3.

Referring also to FIG. 3, in this embodiment the cylinder comprises two sets 44, 46 of the transfer ports 36. The first set of transfer ports 44 comprises a pair of first transfer ports 48. The second set of transfer ports 46 comprises a pair of second transfer ports 50. However, in alternate embodiments, the cylinder could comprise more than two sets of transfer ports, and each set of transfer ports could comprise more or less than two transfer ports each. The first set 44 of transfer ports are disposed closer to the exhaust port 34 than the second set 46 of transfer ports; which are disposed further away from the exhaust port 34.

As seen best in FIG. 3, the transfer passage walls of the transfer ports 36 are angled with respect to the cylinder axis 60 and the point of intersection 61 of the imaginary plane extending from the transfer passage walls. The first transfer ports 48 are angled relative to each other at a first angle 52. In a preferred embodiment, the first angle 52 is about 70° to about 85°. In one specific form of embodiment, the first angle 52 is about 79°. The second transfer ports 50 are angled relative to each other at a second angle 54. In a preferred embodiment, the second angle 54 is about 120° to about 150°. In one specific form of embodiment, the second angle 54 is about 141°.

In one type of embodiment, the main internal area 38 of the cylinder 12 has a diameter of about 1.375 in. Flows form the transfer ports 36 can be directed towards an inner most general area 61 of the intersection which is spaced at a distance 66 form the cylinder axis 60. For the diameter of about 1.375 in., the distance 66 can be about 0.3 inch to about 0.412 inch.

The transfer ports 36 are angled towards a front of the cylinder in a direction away from the exhaust port 34. The transfer ports 36 extend upward form the bottom 40 of the cylinder to a middle section of the cylinder. The transfer ports 36 extend outward from the main internal area 38 into the interior side walls of the cylinder 12. The transfer ports 36 are preferably wider at their base, proximate the bottom 40, then at their top ends 56, 58. The top ends 56, 58 are substantially flat. However, in alternate embodiments, the top ends could have any suitable type of shape.

As seen best in FIG. 2, the top ends 56 of the first transfer ports 48 are shorter than the top ends 58 of the second transfer ports 50. The transfer ports 36 are opened and closed relative to the combustion chamber 42 as the piston 14 moves up and down in the main internal area 38 of the cylinder 12. Because of the difference in height between the top ends 56, 58 of the first and second transfer ports 48, 50, there is a differential in timing of opening of the second transfer ports 50 relative to the first transfer ports 48 as the piston moves downward in the cylinder towards is bottom dead center (BDC) position. More specifically, as the piston 14 moves downward in the cylinder, 12, the second pair of transfer ports 50 are opened into the combustion chamber 42 before the first pair of transfer ports 48 are opened. As the piston 14 continues to move towards its bottom dead center position, the second pair of transfer ports 50 are subsequently opened. Because the second transfer ports 50 are located further away from the exhaust port 34 than the first transfer ports 48, the transfer ports located furthest away from the exhaust port 34 open first. The combination of the sequential opening of the different types of transfer ports and the angled shaped of the transfer ports combine to help prevent short circuiting of fresh unburned fuel from exiting the exhaust port 34.

Unlike conventional two-stroke engines, the front and rear pair of transfer ports have a phase difference in timing of their opening. As the piston moves downward towards a bottom dead center position, the piston uncovers the front ports, i.e., the second pair of ports 50 about four to eight degrees sooner than the rear ports, i.e., the first pair of transfer ports 48 are uncovered. During the early scavenging process, the front ports 50, which opened sooner, discharge live charge (fuel and air) into the cylinder, away form the exhaust port 34 due to directional discharge characteristics of the ports. The charge that is discharged furthest away from the exhaust port enters the cylinder first and, also travels the longest distance. The earliest entering charge is also the fraction of the total charge that is most likely to be lost into the exhaust 34. Even though the charge that enters through the second transfer ports 50 enters first, it has to travel the farthest and is the least amount of charge entering from the two sets 44, 46. Thus, the fractional loss is also minimum.

The early opening of the front two 50 of the four transfer ports helps to establish a flow path for the charge that follows in such a way that it may result in a near-perfect displacement scavenging. Thus, flow pattern and staggered discharge of live charge helps minimize the loss of resh fuel into the exhaust, which results in lower emissions and higher fuel economy.

The top ends 58 of the second transfer ports 50 can be located below the top end of the exhaust port 34. The width of the second transfer ports 50 can be smaller than the width of the first transfer ports 48. The use of a tapered shape along the height of the second transfer ports 50 can also reduce the side of the opening of the second transfer ports when the second transfer ports 50 are uncovered by the piston 14. It is believed that narrow opening of the front ports late during the blow-down process can increase the discharge velocity, which helps mixing. Low short circuit loss of fresh charge combined with improved mixing reduces significantly the exhaust emissions.

Figure 4:
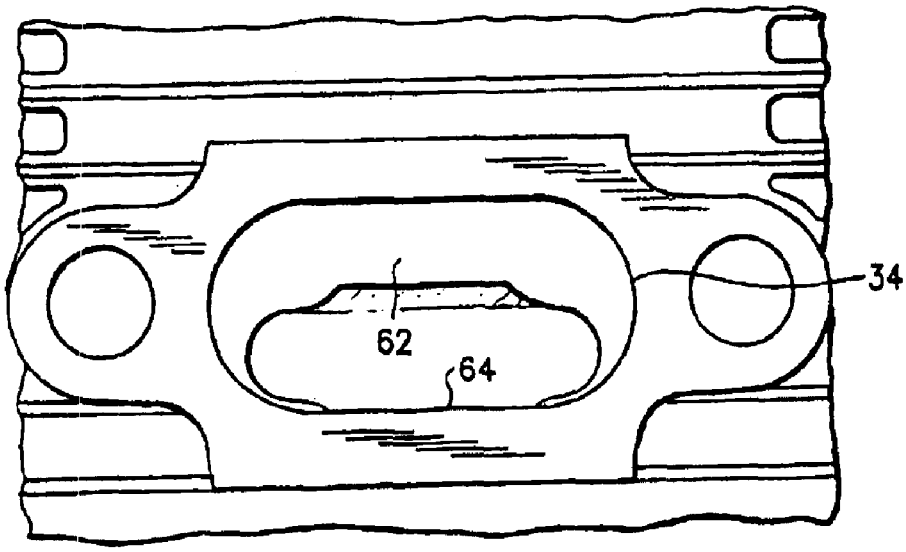
FIG. 4 is a partial side elevational view of the side of the cylinder shown in FIG. 2 showing the exhaust port.

Referring also to FIG. 4, in the embodiment shown the exhaust port 34 comprises a general chevron shaped wall. More specifically, in the embodiment shown, the top side 62 of the exhaust port 34 has a chevron shape, the top side 62 of the exhaust port 34 has a chevron shape, and the bottom side 64 has an opposite chevron shape. As the piston 14 uncovers the exhaust port 34, the initial opening of the exhaust port 34 is relatively small because the apex of the upper chevron wall is merely uncovered. As the piston 14 continues to uncover more of the exhaust port 34, the opening into the exhaust port is enlarged. The chevron shaped exhaust port provides a stepped flow area which can result in optimum blow-down performance. The engine could be provided with the transfer port feature described above alone, or in combination with the chevron shaped exhaust port as shown in FIG. 4.

Tests of an engine incorporating features of the proposed invention has demonstrated emissions below 2004 EPA Phase II emission levels without the use of a catalytic converter. Implementation of the present invention into a conventional engine design is relatively simple and existing hardware (such as pistons, etc.) Can be used with the redesigned cylinder described above. Tooling cost to implement the features of the present invention is minimal. The following table shows results of such a test and variations of port configurations on a 30 cc engine. Similar testing on a 25 cc engine has demonstrated low emission levels.

| | Transfer Port Timing in Degrees | Exhaust Port Timing in Degrees | Power | HC & NOx |
|---|---|---|---|---|
| #1 cyl. Version 1 | 137 (all) | 118 | 0.74 hp @ 7500 rpm | 66.96 @ 7500 rpm |
| #1 cyl. Version 2 | 134, 129 (staggered) | 118 | 0.90 hp @ 7500 rpm | 53.33 @ 9000 rpm |
| #2 cyl. | 129 (all) | 118 | 0.91 hp @ 7500 rpm | 57.90 @ 8500 rpm |
| #3 cyl. | 134, 129 (staggered) | 118 | 0.90 hp @ 7500 rpm | 60.85 @ 8500 rpm |

Figure 5:
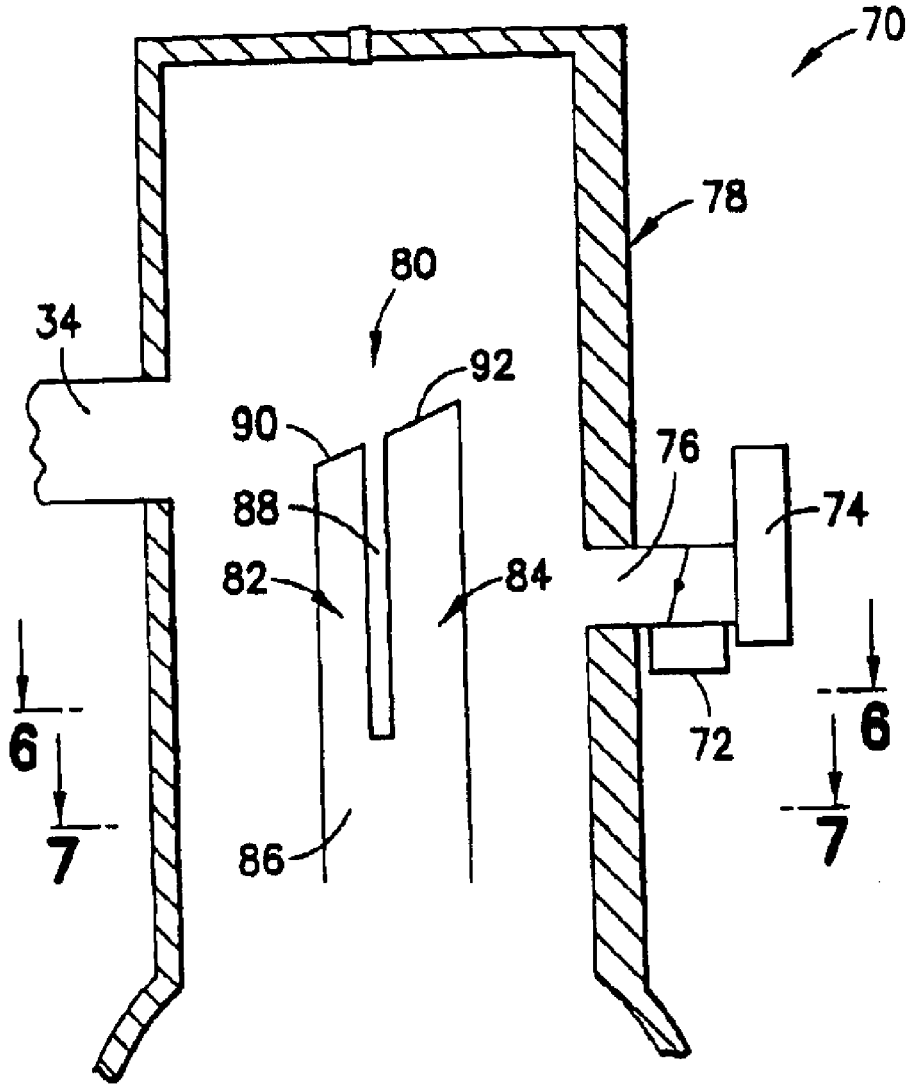
FIG. 5 is a diagrammatic view of a portion of an internal combustion engine comprising an alternate embodiment of the present invention.
Figure 6:
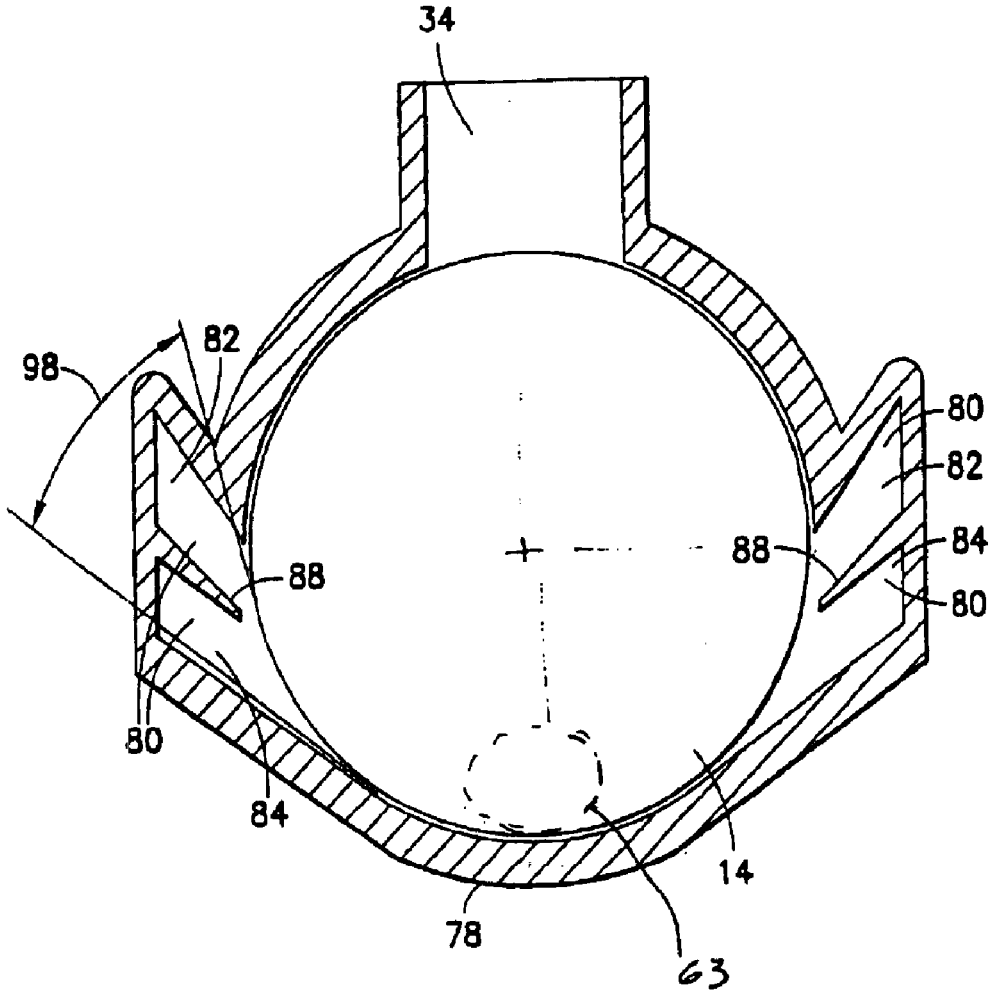
FIG. 6 is a cross sectional view of the cylinder shown in FIG. 5 taken along line 6—6.
Figure 7:
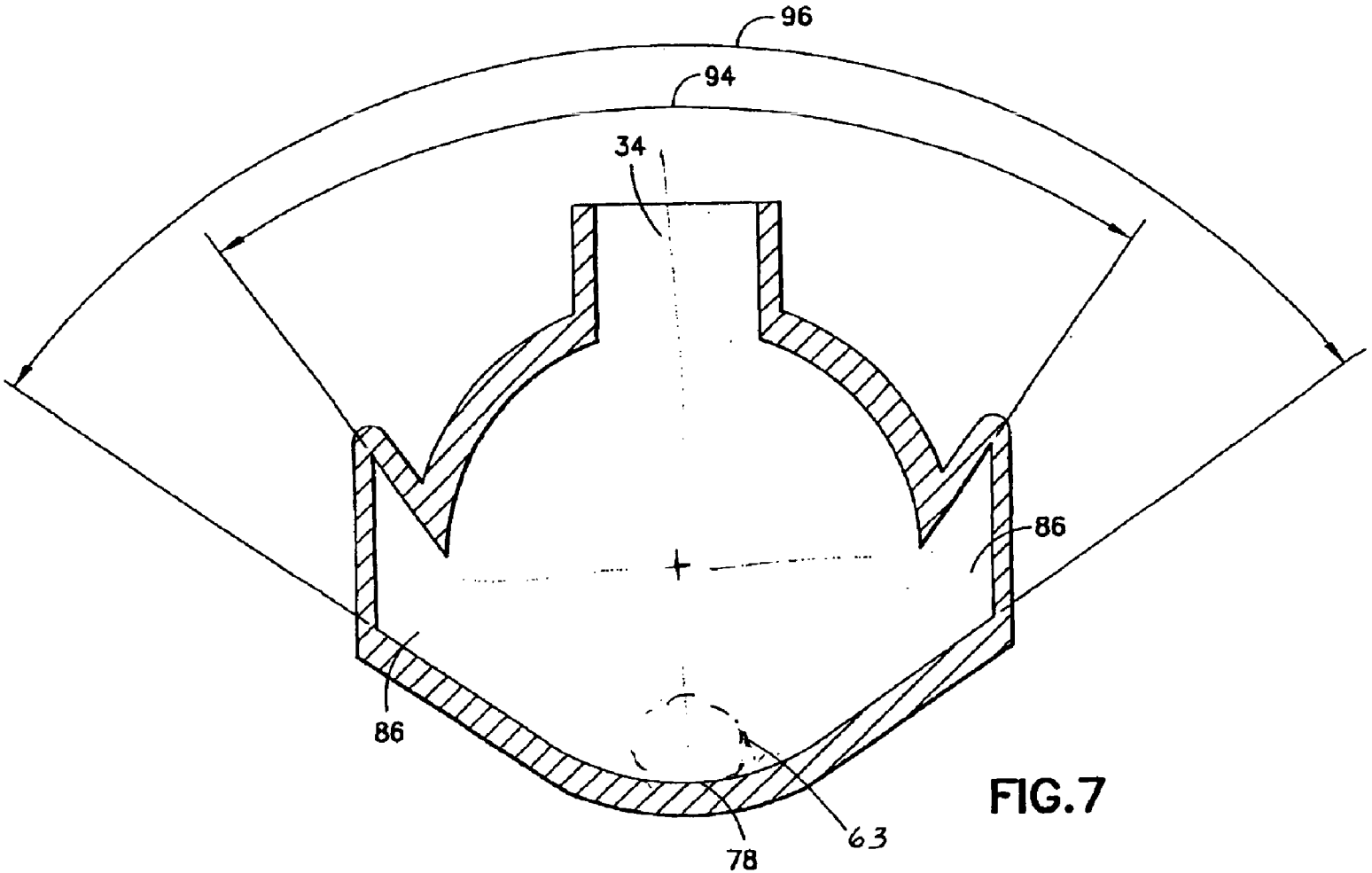
FIG. 7 is a cross sectional view of the cylinder shown in FIG. 5 taken along line 7—7.

Referring now to FIGS. 5–7, an alternate embodiment of the present invention will be described. In this embodiment the engine 70 comprises a fuel delivery system 72 with an air filter 74 and an inlet 76 extending into the cylinder 78. The cylinder 78 also comprises an exhaust outlet 34 and four transfer ports 80. The transfer ports 80 comprise a first set of first transfer ports 82 and a second set of transfer ports 84.

Pairs of the transfer ports, on each side of the cylinder, comprise a common bottom channel 86 extending into the side wall of the cylinder in a bottom portion of the cylinder, and separate respective top channels which form two of the ports 82, 84. The cylinder 78 comprises a partition wall 88 which extends between the two ports 82, 84 to form the two separate top channels. In the embodiment shown, the partition wall 88 comprises a general triangular cross section. However, in alternate embodiments, the wall 88 could comprise any suitable cross sectional shape. The wall 88 has a height that is about two-thirds the heights of the ports 82, 84. In the embodiment shown, the forward and rearward sides of the bottom channels 86 are angled relative to each other at angles 94 and 96. In one embodiment, the angle 94 is about 80° and the angle 96 is about 130°. However, in alternate embodiments, any suitable angles could be provided. This embodiment can be formed the same angles 52, 54, shown in the embodiment of FIG. 3. The top ends 90, 92 comprise top surfaces which are angled downward in a direction of the exhaust port 34. The second transfer ports 84 each comprise a top surface at the ends 92 which is at least partially higher than a top surface of the first transfer ports 82 at th ends 90 such that the second transfer ports open before th first transfer ports as the piston moves towards a bottom dead center position.

There is provided a progression of discharge angle 98 due to curvature of the piston. The partition walls 88 need not extend all the way to the piston 14. One of the features of this embodiment, is that the pairs of transfer ports 82, 84 can be provided in a relatively compact area. This allows features of the present invention to be used in relatively small size cylinders. In an alternate embodiment, the top ends of the transfer ports could be substantially straight and horizontal, and the top surface of the piston could be angled to allow a stepped progression of entry of a charge into the combustion chamber. In another alternate embodiment, the top surfaces of the transfer ports might not be straight, but could be non-straight.

Figure 8:
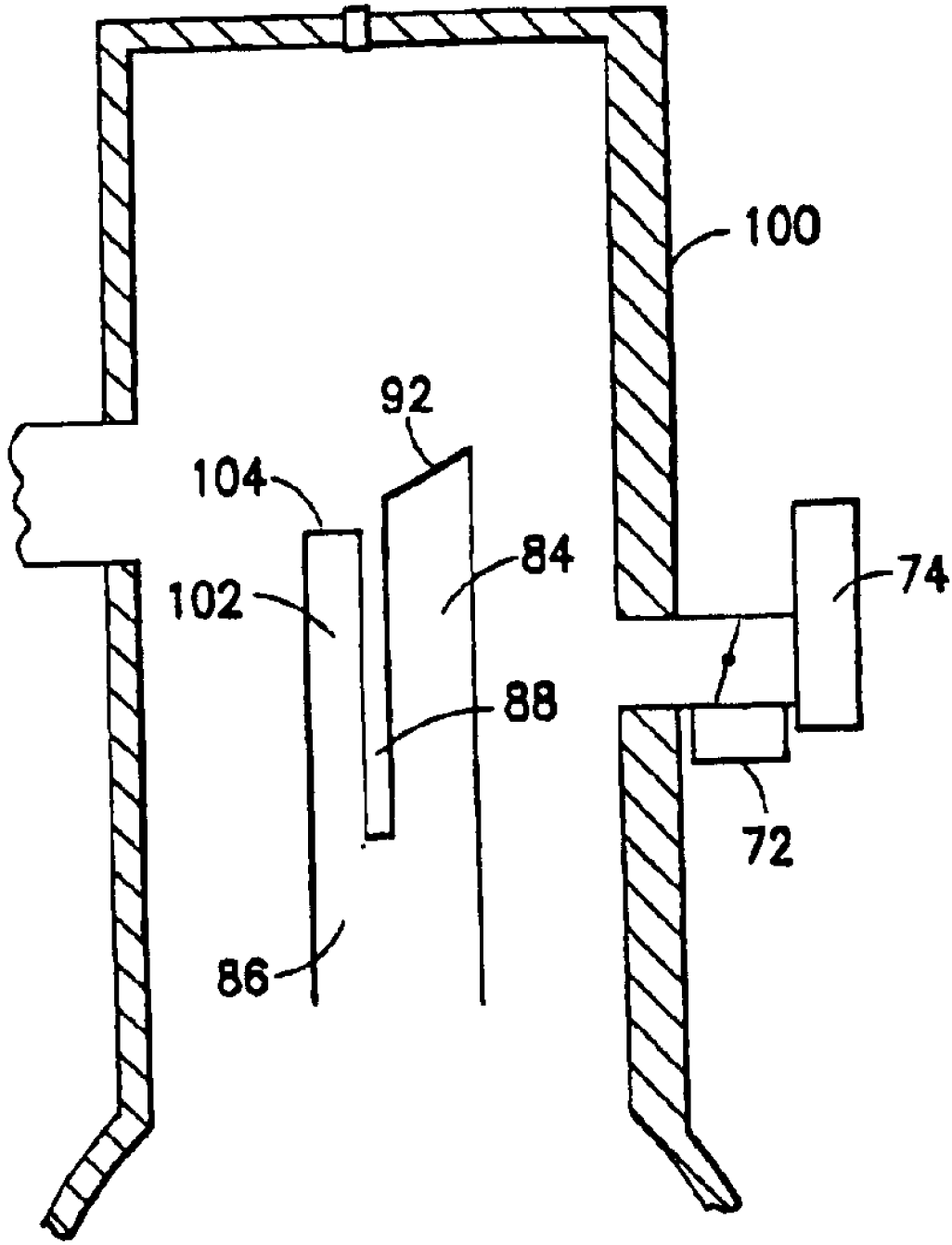
FIG. 8 is a diagrammatic view of a portion of an internal combustion engine comprising another alternate embodiment of the present invention.

Referring now also to FIG. 8, another alternate embodiment is shown. In this embodiment, the cylinder 100 comprises transfer ports with a first type of transfer ports 102 and a second type of transfer port 84, the first and second transfer ports 102, 84 comprise a common bottom channel 86. A partition wall 88 is located at a top of the bottom channel 86 and separates the two ports 102, 84 from each other. This embodiment differs from the embodiment shown in FIG. 5 in that the top end 104 of the first transfer port 102 is substantially straight and horizontal. However, the top end 92 of the second transfer port 84 is inclined downward.

Figure 9:
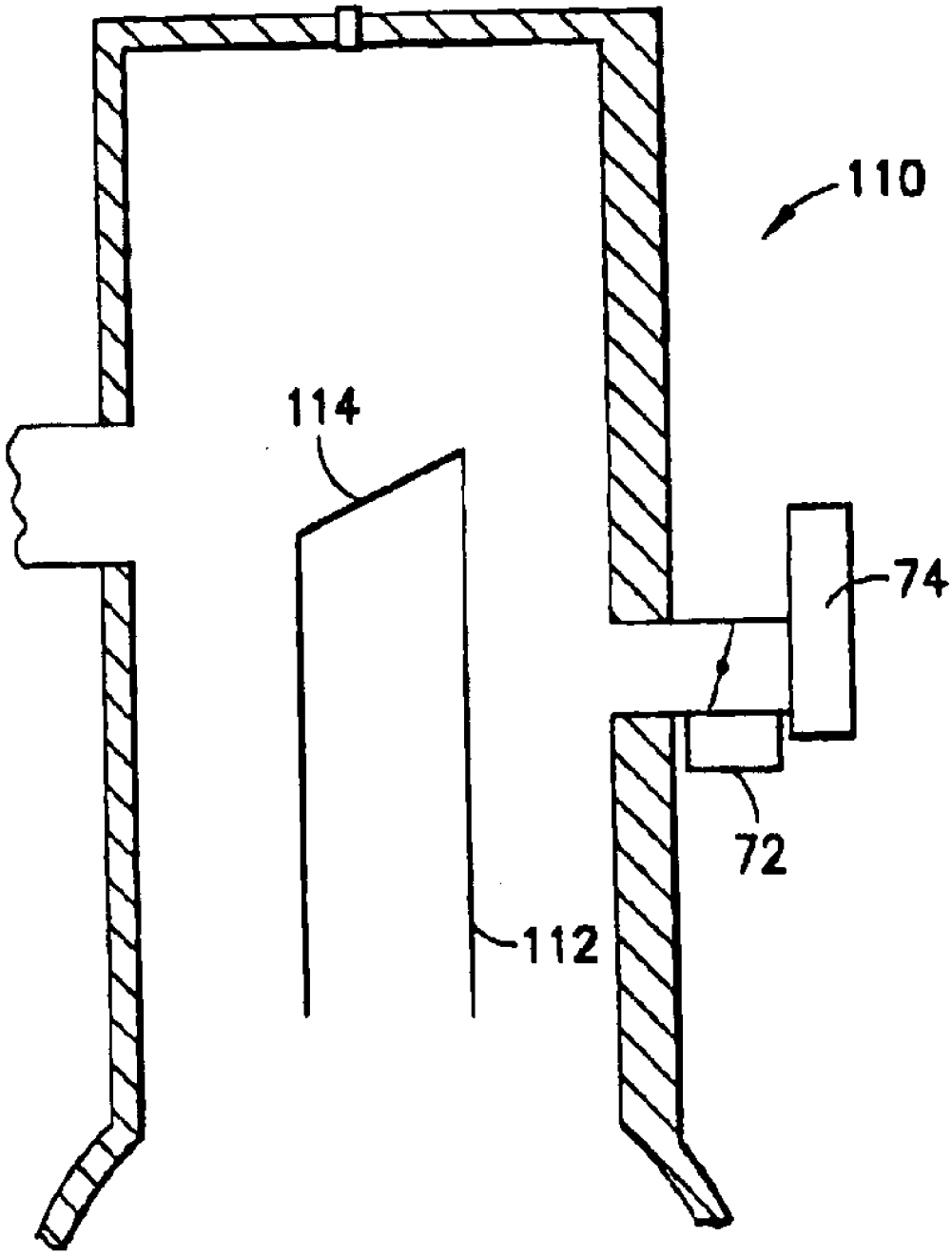
FIG. 9 is a diagrammatic view of a portion of an internal combustion engine comprising another alternate embodiment of the present invention.

Referring now also to FIG. 9, another alternate embodiment of the present invention, another alternate embodiment of the present invention is shown. In this embodiment the engine 110 comprises nearly two transfer ports 112 located on opposite sides of the cylinder. Each of the transfer ports 112 comprise an angled top surface 114.

The following tables illustrate the exhaust and transfer port areas as a function of piston position in crank angle degrees with 0 representing piston top dead center (TDC) and 180 representing piston bottom dead center (BDC). Four engines W through Z, ranging in displacement from 25 to 40 cc. have been evaluated having a four transfer port design as generally illustrated in FIGS. 1–4. A prior art standard two-stroke cycle engine having a 30 cc displacement and a single pair of transfer ports is provided for comparison purposes.

Engine W displacement 25.4 cc

| Crankshaft rotation 0 = TDC | Exhaust Area | Transfer Port I | Transfer Port II | Total I + II |
|---|---|---|---|---|
| 118 | 0.0 | 0.0 | 0.0 | 0.0 |
| 119 | 1.3 | 0.0 | 0.0 | 0.0 |
| 120 | 3.1 | 0.0 | 0.0 | 0.0 |
| 121 | 5.7 | 0.0 | 0.0 | 0.0 |
| 122 | 8.6 | 0.0 | 0.0 | 0.0 |
| 123 | 11.7 | 0.0 | 0.0 | 0.0 |
| 124 | 14.7 | 0.0 | 0.0 | 0.0 |
| 125 | 17.8 | 0.0 | 0.0 | 0.0 |
| 126 | 20.8 | 0.0 | 0.0 | 0.0 |
| 127 | 23.8 | 0.0 | 0.0 | 0.0 |
| 128 | 26.8 | 0.0 | 0.0 | 0.0 |
| 129 | 29.8 | 0.0 | 0.0 | 0.0 |
| 130 | 32.7 | 0.0 | 0.0 | 0.0 |
| 131 | 35.5 | 0.0 | 0.3 | 0.3 |
| 132 | 39.8 | 0.0 | 0.9 | 0.9 |
| 134 | 43.8 | 0.0 | 1.6 | 1.6 |
| 135 | 47.8 | 0.0 | 2.3 | 2.3 |
| 137 | 51.7 | 0.4 | 3.0 | 3.4 |
| 139 | 56.5 | 1.6 | 3.9 | 5.5 |
| 141 | 61.1 | 2.8 | 4.7 | 7.5 |
| 143 | 65.4 | 3.9 | 5.5 | 9.4 |
| 145 | 69.5 | 5.0 | 6.2 | 11.3 |
| 147 | 73.2 | 6.1 | 7.0 | 13.0 |
| 150 | 78.3 | 7.5 | 7.9 | 15.5 |
| 153 | 82.8 | 8.8 | 8.9 | 17.7 |
| 156 | 86.5 | 10.0 | 9.7 | 19.7 |
| 159 | 89.4 | 11.1 | 10.4 | 21.5 |
| 164 | 92.9 | 12.5 | 11.4 | 23.9 |
| 169 | 95.1 | 13.6 | 12.1 | 25.7 |
| 174 | 96.1 | 14.3 | 12.6 | 26.8 |
| 179 | 96.3 | 14.6 | 12.8 | 27.4 |
| 180 | 96.3 | 14.6 | 12.8 | 27.4 |

All area measurements in sq mm

Engine X displacement 25 cc

| Crankshaft rotation O = TDC | Exhaust Area | Transfer Port A | Transfer Port B | A + B |
|---|---|---|---|---|
| 118 | 0.0 | 0.0 | 0.0 | 0.0 |
| 119 | 0.7 | 0.0 | 0.0 | 0.0 |
| 120 | 2.4 | 0.0 | 0.0 | 0.0 |
| 121 | 4.2 | 0.0 | 0.0 | 0.0 |
| 122 | 6.1 | 0.0 | 0.0 | 0.0 |
| 123 | 8.0 | 0.0 | 0.0 | 0.0 |
| 124 | 10.0 | 0.0 | 0.0 | 0.0 |
| 125 | 12.2 | 0.0 | 0.0 | 0.0 |
| 127 | 16.0 | 0.0 | 0.0 | 0.0 |
| 128 | 20.1 | 0.5 | 0.0 | 0.5 |
| 130 | 24.5 | 1.4 | 0.0 | 1.4 |
| 131 | 28.9 | 2.4 | 0.1 | 2.5 |
| 133 | 34.8 | 3.6 | 1.7 | 5.3 |
| 135 | 40.5 | 4.8 | 3.4 | 8.2 |
| 137 | 46.2 | 6.0 | 5.0 | 11.0 |
| 139 | 51.6 | 7.1 | 6.6 | 13.7 |
| 141 | 56.8 | 8.2 | 8.1 | 16.3 |
| 144 | 64.2 | 9.6 | 10.2 | 19.9 |
| 147 | 71.1 | 11.0 | 12.2 | 23.2 |
| 150 | 77.3 | 12.3 | 14.0 | 26.3 |
| 153 | 82.9 | 13.4 | 15.7 | 29.1 |
| 158 | 90.7 | 15.1 | 18.0 | 33.1 |
| 163 | 96.8 | 16.4 | 19.9 | 36.3 |
| 168 | 101.2 | 17.4 | 21.3 | 38.7 |
| 173 | 104.0 | 18.0 | 22.2 | 40.3 |
| 178 | 105.3 | 18.3 | 22.7 | 41.0 |
| 180 | 105.4 | 18.4 | 22.7 | 41.1 |

All area measurements in sq mm

Engine Y displacement 30 cc

| Crankshaft rotation 0 = TDC | Exhaust Area | Transfer Port A | Transfer Port B | A + B |
|---|---|---|---|---|
| 118 | 0.0 | 0.0 | 0.0 | 0.0 |
| 119 | 1.0 | 0.0 | 0.0 | 0.0 |
| 120 | 2.7 | 0.0 | 0.0 | 0.0 |
| 121 | 4.6 | 0.0 | 0.0 | 0.0 |
| 122 | 6.6 | 0.0 | 0.0 | 0.0 |
| 123 | 8.7 | 0.0 | 0.0 | 0.0 |
| 124 | 10.9 | 0.0 | 0.0 | 0.0 |
| 125 | 13.2 | 0.0 | 0.0 | 0.0 |
| 127 | 17.1 | 0.0 | 0.0 | 0.0 |
| 128 | 21.4 | 0.0 | 0.0 | 0.0 |
| 130 | 25.9 | 0.0 | 0.0 | 0.0 |
| 131 | 30.3 | 0.7 | 0.0 | 0.7 |
| 133 | 36.3 | 1.9 | 0.0 | 1.9 |
| 135 | 42.2 | 3.1 | 0.0 | 3.1 |
| 137 | 47.9 | 4.2 | 0.4 | 4.7 |
| 139 | 53.4 | 5.4 | 2.0 | 7.3 |
| 141 | 58.7 | 6.4 | 3.6 | 10.0 |
| 144 | 66.3 | 7.9 | 5.8 | 13.7 |
| 147 | 73.2 | 9.3 | 7.9 | 17.2 |
| 150 | 79.6 | 10.5 | 9.8 | 20.4 |
| 153 | 85.3 | 11.7 | 11.5 | 23.2 |
| 158 | 93.5 | 13.3 | 14.0 | 27.4 |
| 163 | 99.8 | 14.7 | 16.0 | 30.7 |
| 168 | 104.5 | 15.6 | 17.5 | 33.1 |
| 173 | 107.5 | 16.3 | 18.5 | 34.8 |
| 178 | 108.9 | 16.6 | 18.9 | 35.5 |
| 180 | 109.0 | 16.6 | 19.0 | 35.6 |

All area measurements in sq mm

Engine Z displacement 40 cc

| Crankshaft rotation 0 = TDC | Exhaust Area | Transfer Port A | Transfer Port B | A + B |
|---|---|---|---|---|
| 118 | 0.0 | 0.0 | 0.0 | 0.0 |
| 119 | 0.0 | 0.0 | 0.0 | 0.0 |
| 120 | 1.0 | 0.0 | 0.0 | 0.0 |
| 121 | 3.0 | 0.0 | 0.0 | 0.0 |
| 122 | 5.1 | 0.0 | 0.0 | 0.0 |
| 123 | 7.2 | 0.0 | 0.0 | 0.0 |
| 124 | 9.4 | 0.0 | 0.0 | 0.0 |
| 125 | 12.1 | 0.0 | 0.0 | 0.0 |
| 127 | 17.0 | 0.0 | 0.0 | 0.0 |
| 128 | 22.3 | 0.0 | 0.0 | 0.0 |
| 130 | 27.7 | 0.6 | 0.0 | 0.6 |
| 131 | 33.1 | 1.7 | 0.0 | 1.7 |
| 133 | 40.1 | 3.0 | 0.2 | 3.3 |
| 135 | 47.0 | 4.4 | 2.5 | 5.9 |
| 137 | 53.6 | 5.6 | 4.8 | 10.4 |
| 139 | 59.9 | 6.9 | 6.9 | 13.8 |
| 141 | 66.0 | 8.0 | 9.0 | 17.0 |
| 144 | 74.5 | 9.7 | 11.8 | 21.5 |
| 147 | 82.3 | 11.2 | 14.5 | 25.7 |
| 150 | 89.5 | 12.6 | 16.9 | 29.5 |
| 153 | 95.9 | 13.9 | 19.1 | 33.0 |
| 158 | 105.0 | 15.7 | 22.3 | 38.0 |
| 163 | 112.0 | 17.2 | 24.8 | 42.0 |
| 168 | 117.1 | 18.2 | 26.7 | 44.9 |
| 173 | 120.3 | 18.9 | 27.9 | 46.9 |
| 178 | 121.8 | 19.3 | 28.5 | 47.8 |
| 180 | 121.9 | 19.3 | 28.5 | 47.9 |

All area measurements in sq mm

Standard Engine displacement 30 cc

| Crankshaft rotation 0 = TDC | Exhaust Area | Transfer Port A |
|---|---|---|
| 111 | 0.000 | 0.000 |
| 112 | 1.434 | 0.000 |
| 113 | 5.103 | 0.000 |
| 114 | 8.918 | 0.000 |
| 115 | 12.802 | 0.000 |
| 116 | 16.721 | 0.000 |
| 117 | 20.654 | 0.000 |
| 118 | 24.584 | 0.000 |
| 119 | 28.499 | 0.000 |
| 120 | 32.389 | 0.000 |
| 121 | 36.244 | 0.000 |
| 122 | 40.057 | 0.000 |
| 123 | 43.822 | 0.000 |
| 124 | 47.531 | 0.000 |
| 125 | 51.181 | 0.000 |
| 126 | 54.771 | 0.000 |
| 127 | 58.301 | 0.000 |
| 128 | 61.770 | 0.000 |
| 129 | 65.178 | 0.000 |
| 130 | 68.524 | 0.000 |
| 131 | 71.808 | 0.000 |
| 132 | 75.030 | 0.000 |
| 133 | 78.189 | 0.000 |
| 134 | 81.285 | 0.638 |
| 135 | 84.317 | 2.267 |
| 136 | 87.285 | 3.946 |
| 138 | 93.030 | 7.348 |
| 140 | 98.516 | 10.729 |
| 142 | 103.742 | 14.034 |
| 145 | 111.087 | 18.777 |
| 148 | 117.817 | 23.199 |
| 151 | 123.907 | 27.260 |
| 155 | 131.009 | 32.079 |

-continued

Standard Engine displacement 30 cc

| Crankshaft rotation 0 = TDC | Exhaust Area | Transfer Port A |
|---|---|---|
| 159 | 136.947 | 36.195 |
| 163 | 141.741 | 39.598 |
| 167 | 145.427 | 42.287 |
| 171 | 148.054 | 44.260 |
| 176 | 149.938 | 45.718 |
| 180 | 150.390 | 46.075 |

All area measurements in sq mm

Figure 10:
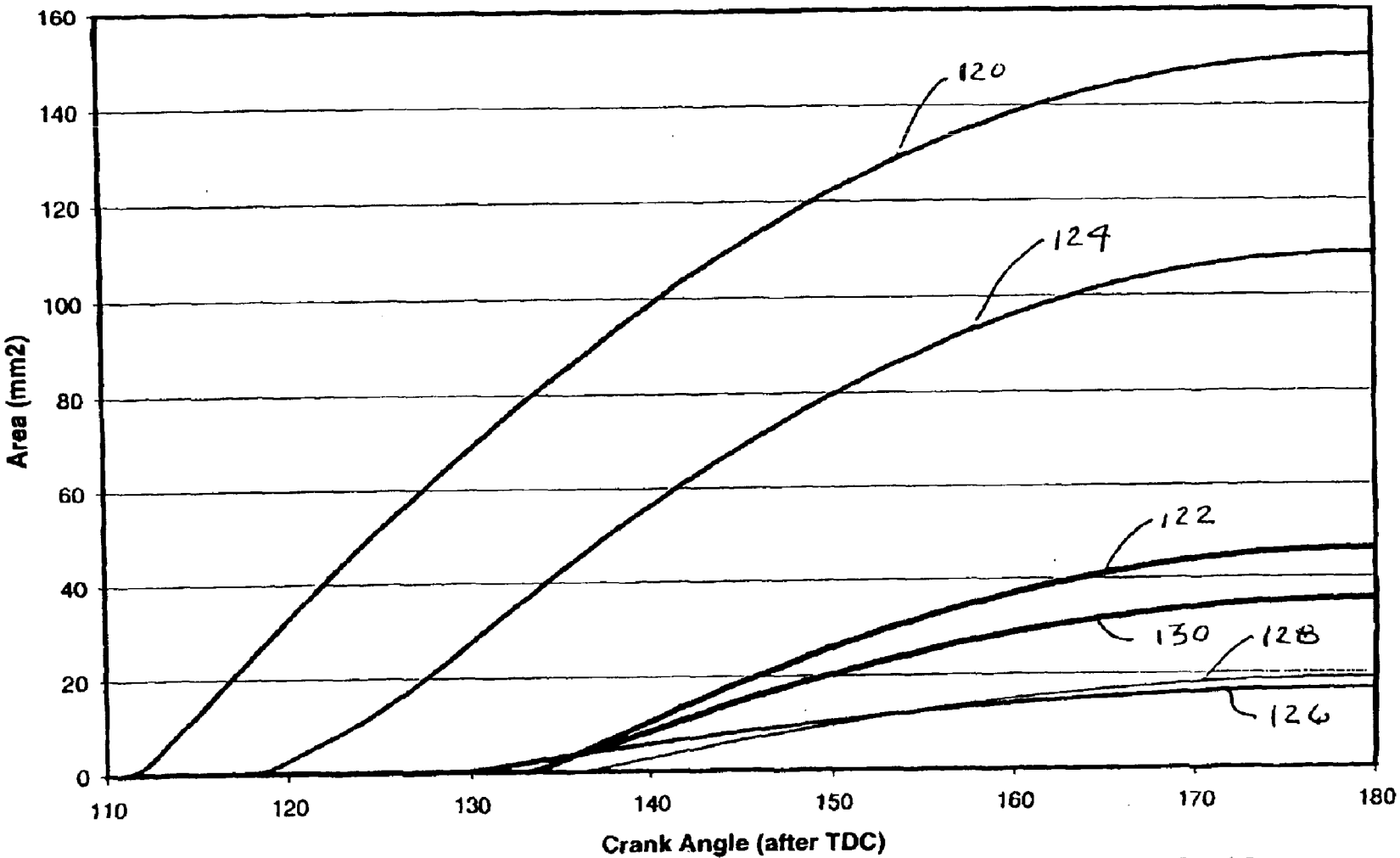
FIG. 10 is a timing chart illustrating the exhaust and transfer port open area relative to piston position in crank angle degrees for the present invention compared to a prior art design.

To better illustrate the relative size and timing of the transfer ports and the exhaust port area of the present invention in contrast to the prior art, a port area versus crank angle timing diagram is provided in FIG. 10. The standard prior art two-stroke engine is represented by exhaust port area curve 120 and transfer port area curve 122. Engine Y, is a comparably sized engine utilizing the present invention. Engine Y has an exhaust port area versus crank angle degree curve 124. Relative to standard exhaust port area curve 120, the present invention is not only slightly lower in maximum area, but is shifted approximately at 10° later in time. Quite subtly, but important, is the shape of the exhaust port area curve 120 as it initially opens. The exhaust port area initially increases more gradually than the prior art due to the chevron shaped exhaust port described previously.

The exhaust port of engine Y has a blow down region which is 20% to 30% of the total port area which has a reduced circumferential length relative to the remaining port region resulting in a more gradual port opening and port closing. This small size blow down region allows for the intake charge to be effectively trapped while still allowing efficient exhaust blow down and discharge so that engine power is not compromised. Preferably, the exhaust blow down region will have a circumferential port length of about 50% of the maximum circumferential length from the remainder of the exhaust port.

As further illustrated in FIG. 10, as well as the accompanying timing charts for engines W–Z, the preferred exhaust port opening occurs between 116°–121° after TDC and preferably, 117°–120° after TDC. Most preferably, the exhaust port opens 118°–119° after TDC.

In addition to delaying exhaust port opening and port opening geometry, engines of the present invention open the transfer ports relatively early. The combined area of the transfer ports result in a more gradual transfer port opening. In FIG. 10, the second transfer port opens initially, as illustrated by curve 126, while the first transfer port area is illustrated by curve 128. The combined areas of the two transfer ports is illustrated by curve 130. As shown graphically in FIG. 10, as well as in engine tables W–Z, the maximum area of the first transfer ports at BDC is greater than that of the second transfer ports at BDC. Preferably, the second transfer ports will have a BDC area which is less than 90% of the BDC area of the first transfer ports at BDC. More preferably, the second transfer port area will be 65%–90% of the first transfer port area at BDC and most preferably, 80%–90% of the second transfer port area at BDC.

The relative timing of the opening of the first and second transfer ports are likewise illustrated in the FIG. 10 graph as well as tables W–Z. The second transfer port opens over 3° prior to the first transfer port, preferably 3°–10° before the first transfer port, and most preferably, 4°–8° before the first transfer port.

The flow of the intake charge into the cylinder in the four transfer port embodiments initially comes from the second transfer ports which are oriented at an included angle of 120°–150° relative to one another as illustrated in FIG. 3. As the piston moves down and opens the first transfer ports, the additional intake charge is introduced into the cylinder and a more pronounced angle relative to the transfer center line with the included angle between the first transfer ports being in the 70°–85° range as illustrated in FIG. 3. The flow through all four transfer ports converges in a transfer port convergence zone 63. The transfer port convergence zone 63 is located along the transverse centerline between the cylinder axis 60 and the cylinder front wall opposite the exhaust port 34. Ideally, the convergence zone is spaced from the bore axis 60, a distance greater than 0.4 times the cylinder radius, preferably, 0.4–0.9 times the cylinder radius and most preferably, 0.5–0.8 times the cylinder radius in the four point embodiment of FIGS. 1–4.

In the alternative embodiments shown in FIGS. 6 and 7, the transfer port convergence zone is located slightly closer to the cylinder wall opposite the exhaust port. It should be appreciated that whether the four port design shown in FIG. 3 is used or the alternative port designs shown in FIGS. 6 and 7 are used, the intake charge initially entering the cylinder is introduced at a greater included angle between the opposed ports then when the charge which is introduced later in the intake cycle when the transfer ports are fully opened. This design serves to maximize scavenge efficiency and intake turbulence while limiting intake charge short circuit losses. The combined benefits of the exhaust and transfer port timing and shape, enables significant improvements in emissions to be achieved without the use of expensive add on emission remediation hardware.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A two-stroke internal combustion engine comprising:

a cylinder; and a piston movably mounted in the cylinder, wherein the cylinder comprises an exhaust and transfer ports, wherein the transfer ports comprise a first pair of the transfer ports disposed closer to the exhaust port than a second pair of the transfer ports which are disposed further away from the exhaust port, wherein the first pair of transfer ports are angled relative to each other at a first angle of about 70° to about 85° and the second pair of transfer ports are angled relative to each other at a second angle of about 120° to about 150°;

wherein directional discharge of scavenged air out of the transfer ports establishes a flow path for the scavenged air to minimize losses of fresh unburned fuel into the exhaust port.

2. A two-stroke internal combustion engine as in claim 1 wherein the second pair of transfer ports comprise top surfaces which are at least partially higher than top surfaces of the first pair of transfer ports such that the second pair of transfer ports open before the first pair of transfer ports as the piston moves towards bottom dead center position.

3. A two-stroke internal combustion engine as in claim 2 wherein the top surfaces of the second pair of transfer ports each have a generally flat inclined surface which is angled downward toward the exhaust port.

4. A two-stroke internal combustion engine as in claim 3 wherein the top surfaces of the first pair of transfer ports each have a generally flat inclined surface which is angled downward toward the exhaust port.

5. A two-stroke internal combustion engine as in claim 3 wherein the top surfaces of the first pair of transfer ports are not generally flat and inclined towards the exhaust port.

6. The two-stroke internal combustion engine of claim 2 wherein the second pair of transfer ports opens over 3 crankshaft degrees before the first pair of transfer ports.

7. The two-stroke internal combustion engine of claim 2 wherein the second pair of transfer ports opens over 3–10 crankshaft degrees before the first pair of transfer ports.

8. The two-stroke internal combustion engine of claim 2 wherein the second pair of transfer ports opens over 4–8 crankshaft degrees before the first pair of transfer ports.

9. A two-stroke internal combustion engine as in claim 1 wherein two of the transfer ports comprise a common bottom channel extending into a side wall of the cylinder in a bottom portion of the cylinder and separate respective top channels, wherein the cylinder comprises a partition wall extending between the two separate top channels to form the two ports.

10. A two-stroke internal combustion engine as in claim 1 wherein the exhaust port provides a stepped flow area having an initial blow down region with a reduced circumferential length relative to the maximum circumferential length of the remaining port area.

11. A two-stroke internal combustion engine as in claim 10 wherein the exhaust port initial blow down region has an area which is 20–30% of the total exhaust port area, with the side walls of the internal blow down region being outwardly inclined forming a truncated chevron shape.

12. A two-stroke internal combustion engine as in claim 1 wherein the first angle is about 79°.

13. A two-stroke internal combustion engine as in claim 1 wherein the second angle is about 141°.

14. The two-stroke internal combustion engine of claim 1 wherein the maximum area of the second set of transfer ports is less than 90% of the maximum area of the first pair of transfer ports when the piston is at BDC.

15. The two-stroke internal combustion engine of claim 1 wherein the maximum area of the second set of transfer ports is between 65%–90% of the maximum area of the first pair of transfer ports when the piston is at BDC.

16. The two-stroke internal combustion engine of claim 1 wherein the maximum area of the second set of transfer ports is between 80%–90% of the maximum area of the first pair of transfer ports when the piston is at BDC.

17. The two-stroke internal combustion engine of claim 1 wherein a flow of intake charge converges in a central convergence zone located along a transverse center line of the cylinder and between the bore axis and the front region cylinder wall opposite the exhaust port.

18. The two-stroke internal combustion engine of claim 17 wherein the center of the transfer port convergence zone is spaced from the bore central axis by an amount greater than four times the cylinder radius.

19. The two-stroke internal combustion engine of claim 17 wherein the center of the transfer port convergence zone is spaced from the bore central axis by an amount equal to 0.4 to 0.9 times the cylinder radius.

20. The two-stroke internal combustion engine of claim 17 wherein the center of the transfer port convergence zone is spaced from the bore central axis by an amount equal to 0.5 to 0.8 times the cylinder radius.

21. A two-stroke internal combustion engine comprising:

a cylinder; and a piston movably mounted within the cylinder;

wherein the cylinder has formed therein an exhaust port and a first pair of transfer ports disposed closer to the exhaust port than a second pair of transfer ports that are disposed further away from the exhaust port, each of the first and second pairs of transfer ports directing intake charge inwardly toward the transverse cylinder axis and generally away for the exhaust port, the charge from the first and second pairs of transfer ports meeting in a compact transfer port convergence zone located between the cylinder axis and a front wall of the cylinder opposite the exhaust port;

wherein the first pair of transfer ports are angled relative to each other at a first angle of about 70° to about 85° and the second pair of transfer ports are angled relative to each other at a second angle of about 120° to about 150°.

22. The two-stroke internal combustion engine of claim 21 wherein the transfer port convergence zone is spaced from the cylinder axis more than 0.4 times the cylinder radius.

23. The two-stroke internal combustion engine of claim 21 wherein the transfer port convergence zone is spaced from the cylinder axis between 0.5 and 0.8 times the cylinder radius.

24. The two-stroke internal combustion engine of claim 21 wherein the exhaust port opens at 116°–121° after TDC.

25. The two-stroke internal combustion engine of claim 21 wherein the exhaust port opens at 117°–120° after TDC.

26. The two-stroke internal combustion engine of claim 21 wherein the second pair of transfer ports open 8°–15° after the exhaust port opens.

27. The two stroke internal combustion engine of claim 21 wherein the second pair of transfer ports open 10°–12° after the exhaust port opens.

28. The two-stroke internal combustion engine of claim 21 wherein the exhaust port has a blow down region which opens first, and which is 20%–30% of the total exhaust port area, the blow down region having a circumferential length along the cylinder wall which is substantially less than the average circumferential length of the remaining portion of the exhaust port thereby allowing efficient exhaust blow down and flow and effective trapping of the intake charge without significantly sacrificing engine power.

29. The two-stroke internal combustion engine of claim 28 wherein the blow down region of the exhaust port has a circumferential port length of approximately 50% of the maximum of exhaust port circumferential lengths.

30. A two-stroke internal combustion engine comprising:

a cylinder; and a piston movably mounted in the cylinder, wherein the cylinder comprises an exhaust port and transfer ports, wherein two of the transfer comprise a common bottom channel extending into a side wall of the cylinder in a bottom portion of the cylinder and separate respective top channels, wherein the cylinder comprises a partition wall extending between the two ports to form the two separate top channels; and wherein the transfer ports comprise a first pair of the transfer ports disposed closer to the exhaust port, wherein the first pair of transfer ports are angled relative to each other at a first angle of about 70° to about 85° and the second pair of transfer ports are angled relative to each other at a second angle of about 120° to about 150°, wherein directional discharge of scavenged air out of the transfer ports establishes a flow path for the scavenged air to minimize losses of fresh unburned fuel into the exhaust port, and wherein the two transfer ports comprise one port from each of the two pair of transfer ports.

31. A two-stroke internal combustion engine as in claim 30 wherein the second pair of transfer ports comprise a top surface which is at least partially higher than a top surface of the a first pair of transfer ports such that the second pair of transfer ports before the first pair of transfer ports as the piston moves toward a bottom dead center position.

32. A two-stroke internal combustion engine as in claim 31 wherein the top surface of the second pair of transfer ports comprises an inclined generally flat surface which is angled downward toward the exhaust port.

33. A two-stroke internal combustion engine as in claim 32 wherein the top surface of the first pair of transfer ports has an inclined generally flat surface which is angled downward on a side closest to the exhaust port.

34. A two-stroke internal combustion engine as in claim 32 wherein the top surface of the first pair of transfer ports is not generally flat and inclined toward the exhaust port.

35. A two-stroke internal combustion engine as in claim 30 wherein the exhaust port comprises an initial blow down region having a generally truncated chevron shaped top wall forming a gradually increasing circumferential port length, which connects to a relatively larger and circumferentially longer main exhaust port.

36. A method of introducing scavenged air into a cylinder of a two-stroke internal combustion engine, the method comprising steps of:

providing the cylinder with an exhaust port and two pair of transfer ports, a first one of the pair of transfer ports being located in closer proximity to the exhaust port than a second one of the pairs of transfer ports, the second pair of transfer ports having generally flat top surfaces which are inclined downward in a direction toward the exhaust port;

opening the second pair of transfer ports to a combustion chamber as a piston moves toward a bottom dead center position before the piston opens the first pair of transfer ports; and opening the first pair of transfer ports by the piston;

wherein the second pair of transfer ports located further away from the exhaust port is opened into the combustion chamber before the first pair of transfer ports is opened into the combustion chamber.

37. A method of introducing scavenged air into a cylinder of a two-stroke internal combustion engine, the method comprising the steps of:

providing the cylinder with an exhaust port and two pair of transfer ports, a first one of the pair of transfer ports being located in closer proximity to the exhaust port than a second one of the pairs of transfer ports, the first pair of transfer ports forming an angle relative to each other about 70° to about 85° and the second pair of transfer ports forming an angle relative to each other about 120° to about 150°;

opening the second pair of transfer ports to a combustion chamber of the engine by a piston of the engine as the piston moves towards a bottom dead center position before the piston opens the first pair of transfer ports; and opening the first pair of transfer ports by the piston;

wherein the second pair of transfer ports located further away from the exhaust port is opened into the combustion chamber before the first pair of transfer ports is opened it the combustion chamber.

* * * * *

UNITED STATES PATENT AND TRADEMARK OFFICE

CERTIFICATE OF CORRECTION

PATENT NO. : 7,100,550 B2
APPLICATION NO. : 10/479260
DATED : September 5, 2006
INVENTOR(S) : John D. Sheldon et al.

It is certified that error appears in the above-identified patent and that said Letters Patent is hereby corrected as shown below:

In the Claims

Column 14, line 8, in claim 31, before "a first part of transfer" delete "the".

Column 14, line 65, in claim 37, before "the combustion chamber" delete "it" and substitute --into-- in its place.

Signed and Sealed this

Third Day of April, 2007

JON W. DUDAS
*Director of the United States Patent and Trademark Office*